United States Patent [19]

Younger, Jr.

[11] Patent Number: 4,909,396

[45] Date of Patent: Mar. 20, 1990

[54] PANEL PRODUCTS DISPLAY RACK

[75] Inventor: William L. Younger, Jr., Virginia Beach, Va.

[73] Assignee: Weyerhaeuser Company, Tacoma, Wash.

[21] Appl. No.: 348,100

[22] Filed: May 2, 1989

Related U.S. Application Data

[63] Continuation of Ser. No. 110,066, Oct. 14, 1987, abandoned, which is a continuation of Ser. No. 837,483, Mar. 7, 1986, abandoned.

[51] Int. Cl.[4] ..... A47G 19/08

[52] U.S. Cl. ..... 211/41; 211/59.4

[58] Field of Search ..... 211/184, 41, 45, 42, 211/59.4, 128

[56] References Cited

U.S. PATENT DOCUMENTS

| | | | |
|---|---|---|---|
| 3,138,261 | 6/1964 | Witteborg | 211/41 |
| 3,732,633 | 5/1973 | Margolis et al. | 211/162 |

FOREIGN PATENT DOCUMENTS

| | | | |
|---|---|---|---|
| 123817 | of 1931 | Australia | 211/41 |
| 2815015 | 10/1979 | Fed. Rep. of Germany | 211/41 |
| 702902 | 4/1966 | Italy | 211/42 |

*Primary Examiner*—Blair M. Johnson

[57] ABSTRACT

An upstanding display rack for holding and displaying a collection of panel products. Extending upwardly from a base member are a plurality of spaced frame members. The frame members are tied together to provide a rigid structure and bins for the panel collection are established between adjacent frame members.

1 Claim, 4 Drawing Sheets

PANEL PRODUCTS DISPLAY RACK

This application is a continuation of application Ser. No. 07/110,066, filed 10/14/87 which is a continuation of 06/837,483, filed 3/7/86, both of which are now abandoned.

BACKGROUND OF THE INVENTION

This invention relates generally to an apparatus useful in displaying panel products at the point of purchase. More particularly it relates to an improved display rack for holding and displaying relatively large panel products, such as decorative 4×8 wood panels used in home applications.

In retail outlets for selling building materials one product line normally carried and offered for sale to the consumeer is the decorative wall panel. Typically these panels are thin plywood panels four feet by eight feet in size having one decorative pattern on a face. With modern panel manufacturing techniques, many decorative patterns can be applied and consequently a retail outlet will usually find it necessary to allocate display space and a suitable structure to hold and display a collection of panels. Of course with a collection of patterns, the consumer must have the opportunity to observe the available patterns.

Large thin flat panels are relatively flexible and somewhat difficult to handle and display effectively. In the past, at the point of purchase an A-frame or H-frame structure was often used to hold and display a collection of panels at one location within a store. These display units normally held and displayed four different panels with a supply of each for the consumer to select when they chose a particular pattern or patterns. A large amount of floor space was taken to contain the display structure and panels being displayed. In addition, the A- and H-frame structures tended to be time consuming to erect and relatively expensive to produce. The retail distributors requested that panel suppliers develop a lower cost, smaller, and easier to erect panel holding and display unit.

The present invention provides a retail outlet with a low cost, small, easy to erect and very functional display rack. The design of the present rack will hold and attractively display a predetermined number of panels with a featured panel displayed with its full face exposed to the consumer. As will be appreciated, the components of the display rack are easy to erect and then disassemble when desired.

It is one object of the present invention to attractively hold and display relatively large thin flat panels at the point of purchase.

Another object is to provide a display rack capable of holding and displaying a predetermined number of panels at a single location.

Still another object of the invention is to provide a low cost, easily erectable and removable display unit.

These and other objects will become apparent upon reading the specification to follow in conjunction with the attached drawings.

SUMMARY OF THE INVENTION

Briefly stated, the present invention is a panel product display rack having a generally rectangular base member that sits substantially at floor level and which has a substantially flat horizontal upper surface, atop which the edges of the displayed panels will rest. Extending upwardly from the top surface of the base member and easily detachable therefrom is a plurality of substantially rectangular frame members at least some of which are comprised of channel members for holding in an upright vertical orientation a panel product. Spaces are provided between adjacent frame members to hold and display a plurality of individual panels usually corresponding in pattern to the panel being displayed within the front adjacent frame member. Preferably the frame members are mounted on the base member at an angle with the plurality of frame members being substantially parallel. A top support ties the frame members together to rigidify the upstanding structure and extending across the frame members along their rear edges is a back support and panel containment means. A separate display sign can be mounted within the triangular area of the front of the display rack and separate information display means can be mounted on each frame member.

DESCRIPTION OF HTE PREFERRED EMBODIMENT

Figure 1:
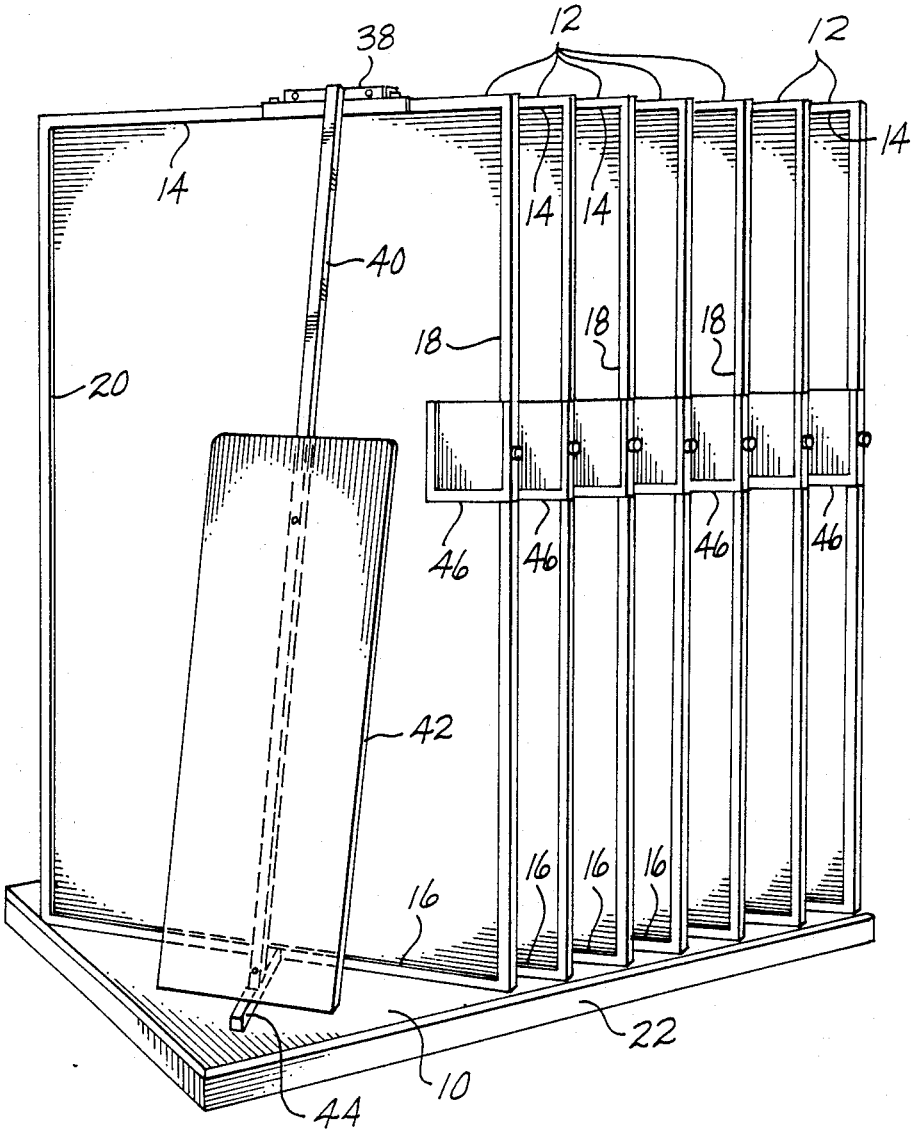
FIG. 1 is an isometric view showing the overall display rack looking forward the front of the rack.
Figure 2:
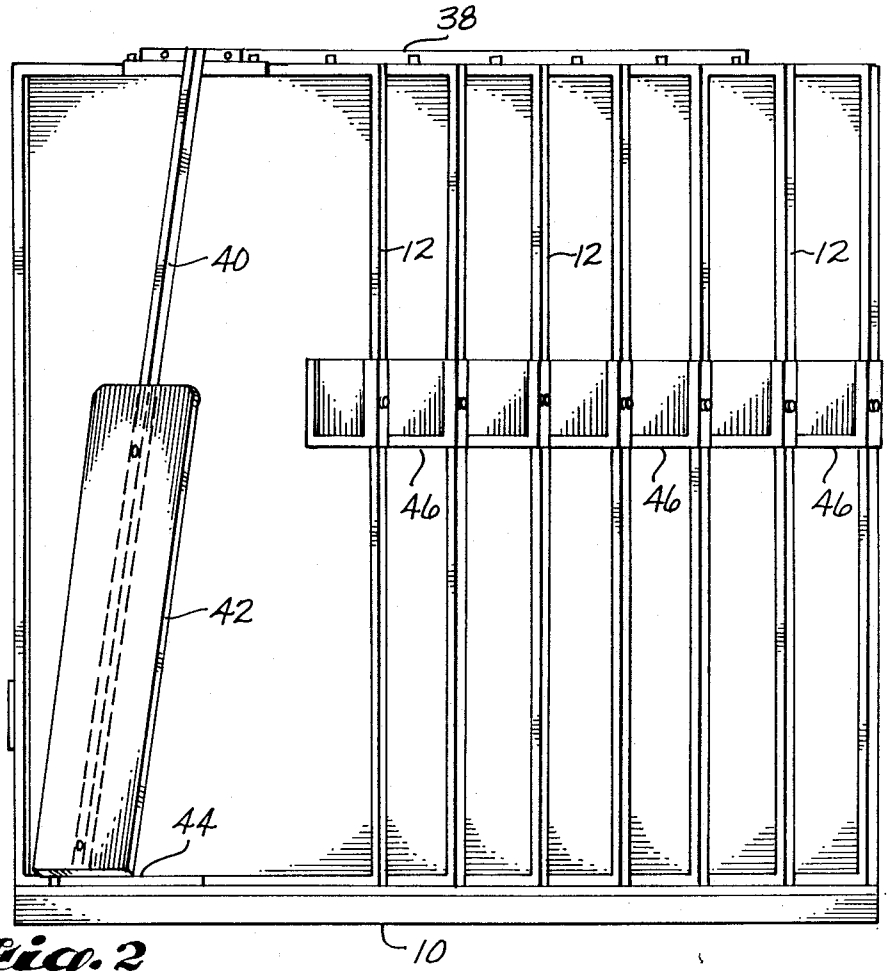
FIG. 2 is a side elevation view looking toward the display side of the rack.
Figure 3:
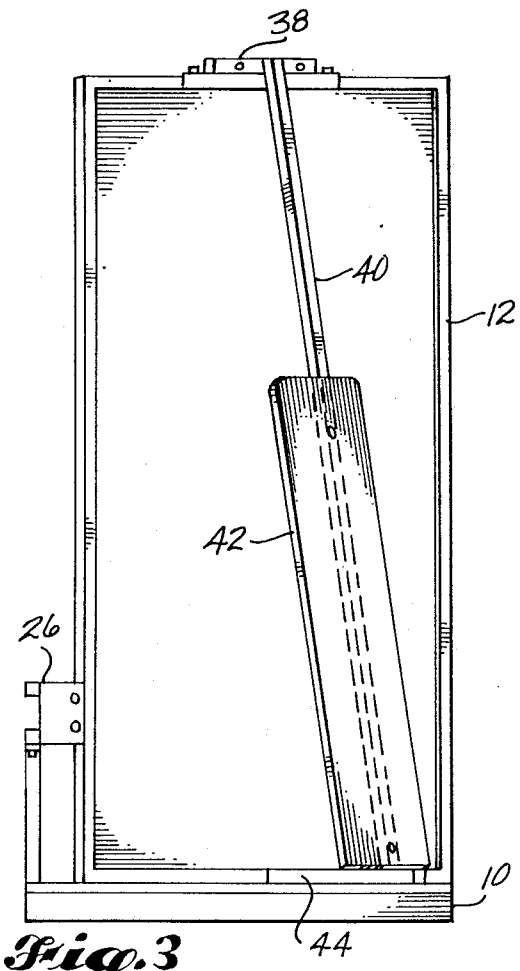
FIG. 3 is an end view looking at the front end of the rack showing the display sign.
Figure 5:
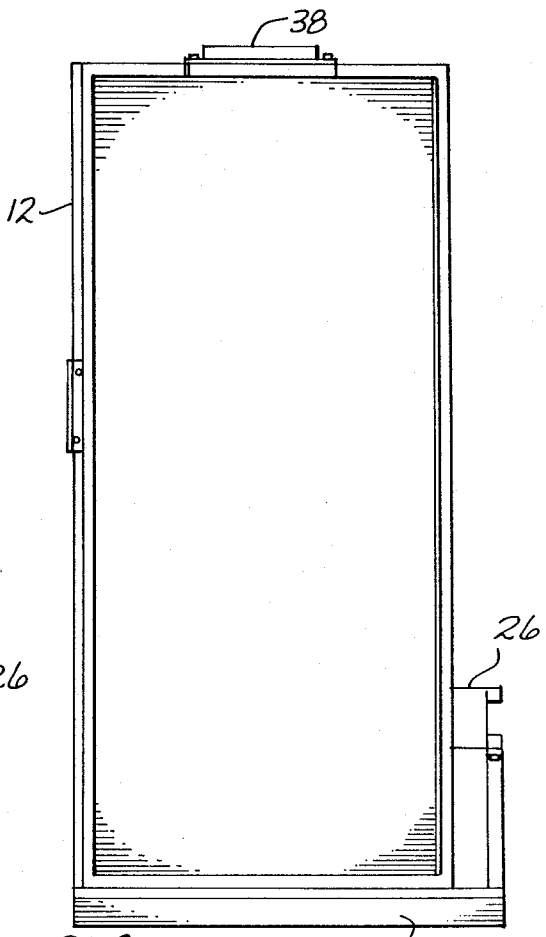
FIG. 5 is an end view of the upstanding rack.
Figure 4:
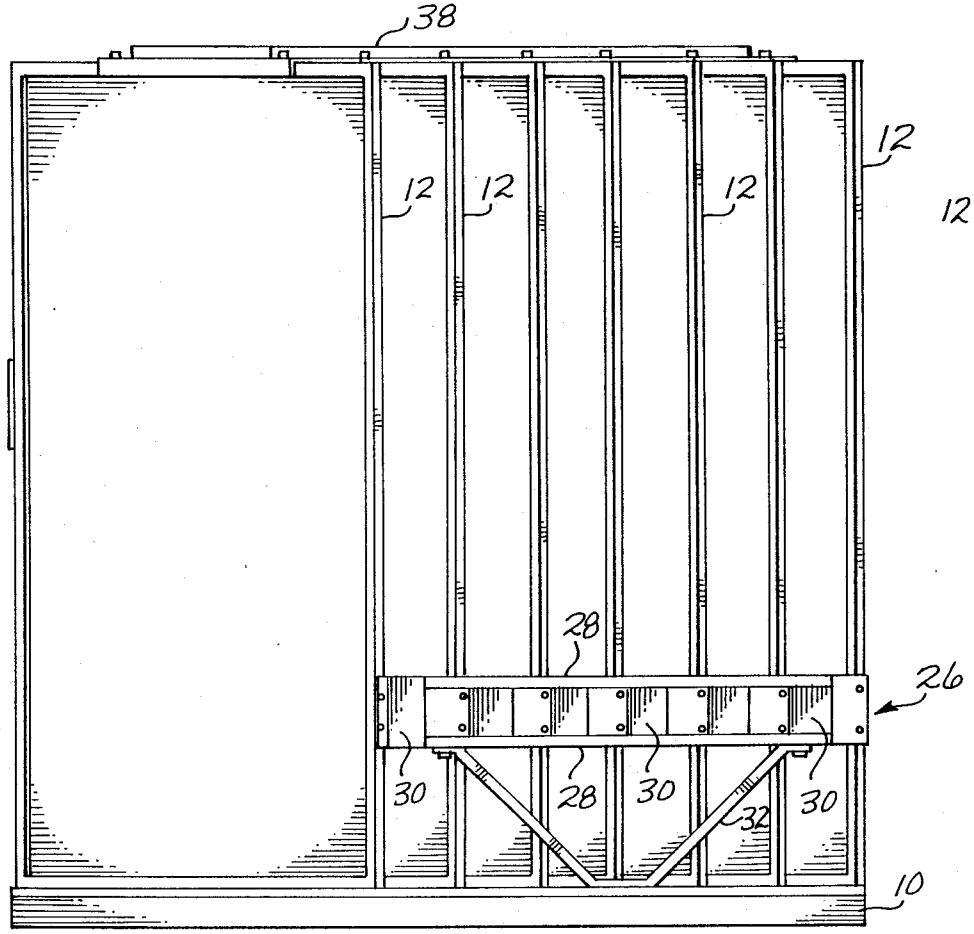
FIG. 4 is an elevation view showing the back of the rack.

Referring to FIG. 1, in which the display rack of the present invention is seen as it would be seen by an interested consumer approaching the display, a base member 10 has a plurality of vertically upstanding frame members 12 extending upwardly therefrom a dimension that will be substantially equal to the long dimension of the panels (not shown) to be held and displayed. The width dimension of each frame member 12 is substantially equal to the width dimension of the panel products to be displayed.

Referring now to all figures, the base member 10 is substantially rectangular, as shown, although it could be another shape. Base member 10 is relatively short as it is intended to rest on a floor to provide a rigid base for the upstanding frame members 12 and panels being held and displayed. At least some of frame members 12 are designed to hold individual panels for a singular panel display in order to continuously display a particular pattern. In order to hold such individual panels the frame members may be comprised of top and bottom channel members 14 and 16 respectively and front and back vertically extending channel members 18 and 20, respectively. An individual panel can then be inserted within the interior spaces of the channel members where it will be held and displayed. The large open area within the perimeter formed by the channel members will allow consumers a good view of each panel with a respective frame member.

Figure 6:
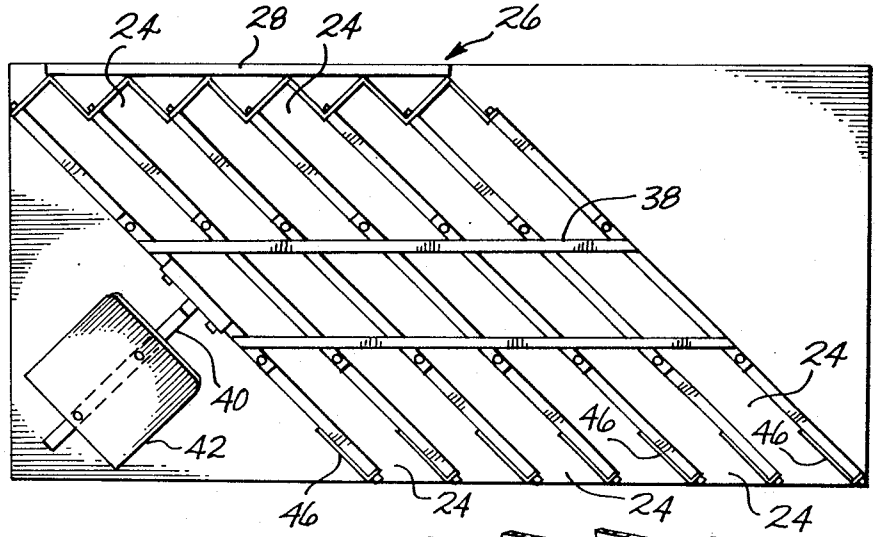
FIG. 6 is a top view looking down on the rack.
Figure 7:
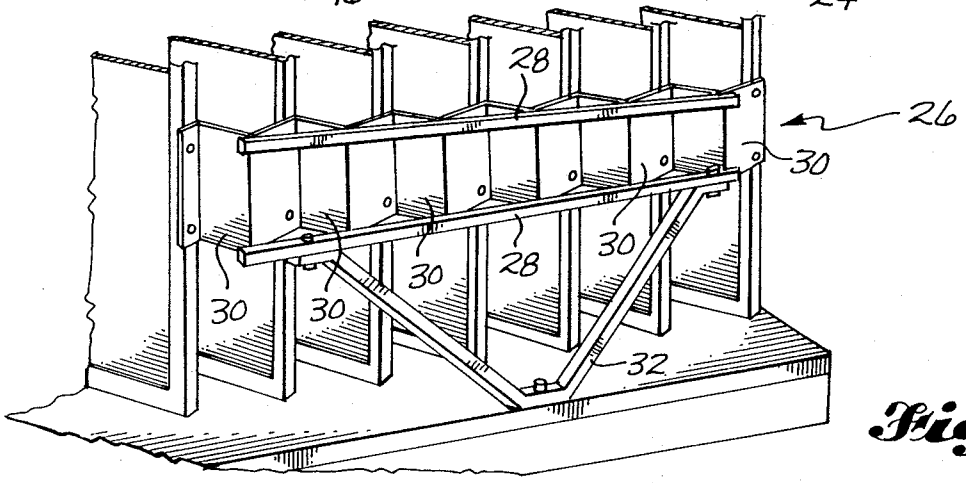
FIG. 7 is a cut away isometric view illustrating the rear back support and containment means.

Along the bottom channel members 16 means (not shown) such as nuts and bolts are provided to attach each member 16 in position. The channel members 16, being seven in number in the embodiment illustrated, are arranged at an angle and spaced apart in a parallel orientation from the front edge 22 of base member 10. The spacing between each frame member 12 forms holding bins 24 for holding up to a predetermined number of panel products. This is best illustrated in FIG. 6. The collection of panels for each bin 24 will be slid into the bin on their bottom edges and will then be supported on the base member 10 and by adjacent frame members 12.

Along the back edge of frame members 12 is a back support and containment structure indicated generally at 26. This structure ties the frame members together for support and includes horizontal brace members 28 and vertical angle members 30 to provide back support and a holding function for the collection of panels. A "V" shaped bracket 32 ties the structure 26 to base member 10. Each element is removably fixed to its adjacent component to provide an easily erectable and detachable display rack.

Serving to tie the frames 12 together over their top edges is ladder frame 38 which rigidily ties together top edges on frames 12. Again ladder frame 38 is removably connected to frame members 12 to provide quick erection and disconnect.

An additional support brace 40 extends between the top edge on the front frame 12 and the outer corner on the base member 10 again providing rigidity to the plurality of frames 12 and the collections of panels within the bins. Mounted on brace 40 is a sign back 42 for holding any message the retail dealer places on back 42 relating to product. A horizontal tie bracket 44 can also be used to provide more rigidity at the bottom of the front frame 12.

Along each vertical edge of a frame 12 along the front side of the display rack a card holder 46 can be mounted to provide a holding means for information related to the particular panel product adjacent to the respective card holder.

All elements forming the erected display rack are adapted to be removably connected together. Once the display rack is erected and located on the floor of the retail outlet then collections of like panels can be inserted into the holding bins which correspond to the panel within the frame member immediately in front of the panel collection.

It will be appreciated that a compact, rigid, readily erectable, low cost display rack has been described that is very effective for holding and displaying large flat thin panel products such as decorative plywood panels. While a detailed description has been provided of the preferred embodiment, modifications may occur to those skilled in the art. The basic design and all modifications are intended to be included within the scope of the appended claim.

I claim:

1. A vertically upstanding easily erectable display and inventory rack for holding and displaying large relatively flat thin panel products, comprising:

a base member for supporting the display and inventory rack on the floor at the point of purchase for the panel products, said base member being relatively short, a plurality of vertically upstanding open parallel frame members removably mounted at an inclined angle with respect to an edge of the base member and laterally spaced apart a distance equal to at least two of the thickness dimensions of the inventoried panels to form holding bins therebetween, at least one panel product removably fixed within the perimeter of each frame member for display and a plurality of panel products placed within the holding bins for easy removal therefrom, and means along the top and back of the plurality of upstanding frame members to tie the frame members together.

* * * * *